US005372209A

United States Patent [19]

Raihert et al.

[11] Patent Number: 5,372,209

[45] Date of Patent: Dec. 13, 1994

[54] POLYCENTRIC REAMER

[75] Inventors: Ludvig A. Raihert, Ljubercj; Takov A. Edelman, Moscow; Alexey G. Messer, Moscow; Abeksandr N. Sorokin, Moscow; Sergei P. Krivonenkov, Moscow; Rudolf S. Alkin, Moscow; Yaroslaw Gavrilov, Kijew; all of Russian Federation

[73] Assignee: DCD, Ltd., Moscow, Russian Federation

[21] Appl. No.: 73,739

[22] Filed: Jun. 8, 1993

[30] Foreign Application Priority Data

Jul. 28, 1992 [RU] Russian Federation ..... 5056939/03

[51] Int. Cl.[5] ..... E21B 10/00

[52] U.S. Cl. ..... 175/325.2; 175/344

[58] Field of Search ..... 175/325.1–325.5, 175/344–350

[56] References Cited

U.S. PATENT DOCUMENTS

| | | | |
|---|---|---|---|
| 1,812,043 | 6/1931 | Grant | 175/346 |
| 2,103,583 | 12/1937 | Howard et al. | 175/344 |
| 2,499,916 | 3/1950 | Harris | 175/346 |
| 2,699,921 | 1/1955 | Garrison | 175/325.2 X |
| 2,790,625 | 4/1957 | Dean | 175/344 |

*Primary Examiner*—Michael Powell Buiz
*Attorney, Agent, or Firm*—Lieberman & Nowak

[57] ABSTRACT

A polycentric reamer having a body thrust unit and reaming unit is especially useful for locally reaming a borehole beneath a casing string. By asymmetrically positioning a reaming unit within a body formed from non-coaxial mated cylinders, superior results are achieved. These results include minimizing wear on the casing string.

15 Claims, 4 Drawing Sheets

POLYCENTRIC REAMER

The invention generally relates to the mining industry, and more particularly, to polycentric reamers for locally reaming a borehole beneath a casing string.

Polycentric reamers having a body with a longitudinal channel, a reaming unit and thrust unit asymmetrically placed within in the body are well known. The body consists of a number of cylinders mating along their surfaces. The longitudinal channel of the body is in alignment with one of the cylinders and the diameter of the thrust unit is less than that of the reaming unit (L. Riley, et al., Large diameter Bi-Center Bits cut drilling cost, *Petroleum International*, 8: 25–30 (1990)).

One disadvantage of such a reamer is that when used in hard and abrasive formations, the rock cutting elements are subject to excess slipping, which results in severe wear.

A known monocentric rock reamer consists of a body and reaming units symmetrically placed in the body. Each reaming unit is made has at least one cone mounted on a supporting shaft fixed in the reamer body in such a way that the axes of the supporting shaft and of the reamer lie in the same plane. The body is made of a number of coaxial cylinders mated along their bottoms and furnished with a longitudinal channel coaxial with the cylinders (P. A. Palily, Korneyev, K. E., "Drilling Bits", Directory, *M. Nedra* 1971, pp. 391–396, FIG. VIII.11, 12, 13).

Such a reamer, having rotating cones whose cutting elements work in a crushing and chipping mode, can be used in hard and abrasive formations. However, a disadvantage of this reamer is that it cannot be used for local reaming of the borehole as is frequently required under a casing string.

A possible disadvantage is damage to the casing string (into which the reamer is being run) by cones as well as wear or the cones itself while running-in.

Another well known polycentric reamer adopted by us as a PROTOTYPE includes a body with the upper connection thread and a longitudinal channel (made from several non-coaxial cylinders mated along their bottoms) and a reaming unit which includes a cone mounted on the supporting shaft whose axis is inclined to the body axis and intersects it, the diameter of the thrust unit being equal to that of the reaming unit (O. Yu Bergschtein, et al., Improving of core recovery technique and technology in deep drilling, *Moscos, Nedra*, p. 157, FIG. 55 (1977)).

A disadvantage of such a reamer is the large volume occupied by the cone could result in trouble or even failure when running into the well. This is especially true for problem wells. Running of such a reamer results in even more damage to the casing string by the cone teeth, as well as in chipping and wearing of the teeth during the running-in operation.

The aim of the subject invention is to improve the efficiency in local reaming of a borehole, particularly in the zone beneath the casing string, to facilitate the operation of the reamer running into the well, and to prevent wear of the reamer rock cutting elements and damage to the casing string into which the reamer is being run.

This objective is achieved through a polycentric reamer having a body, thrust unit and reaming unit. The upper connection thread and longitudinal channel of the body are made up of several non-coaxial cylinders mated along their bottoms. Asymmetrically placed in the body is the thrust unit and the reaming unit which includes at least one cone mounted on a supporting shaft. Unlike the PROTOTYPE where the plane perpendicular to the thread axis passes through a cone point which is at the greatest distance from the axis, the distance from the thread axis to the most remote point of the circumference around the body surpasses the distance from the thread axis to the cone point most remote from the axis. The circumference around the body from the center lying beyond the thread axis intersects the reamer circumference around the cone from the center lying on the thread axis, with a part of the body circumference lying beyond the reamer circumference.

At least a portion of cylinders forming the reamer body are made about the common axis.

Axes of at least a portion of the cylinders forming the body are parallel.

A portion of the cylinders is limited by the surfaces parallel to the cylinder axes.

The axis of the longitudinal channel is displaced relative to all the axes of the body cylinders.

The thrust unit is placed within a cylinder having diameter less than the diameter of the reaming unit.

The axis of the supporting shaft is placed beyond the plane of the thread axis, but in a plane parallel to the thread axis, or parallel or at an angle to the plane which is perpendicular to the thread axis.

The reamer comprises cones placed on the same axis and interconnected to each other.

The axis of the supporting shaft is positioned tangentially to the reamer circumference.

Distinguishing features of the subject approach include (i) the plane being perpendicular to the thread axis and passing through a cone point most remote from this axis, the distance from the thread axis to the most remote point of the circumference circumscribed around the body surmounting the distance from the thread axis to the most remote point of the cone; and (ii) the circumference around the body from the center beyond the thread axis intersects the reamer circumference circumscribed around the cone from the center lying on the thread axis with a portion of circumference delineating the body lying beyond the reamer circumference. These features provide an eccentric reamer having rock cutting and wear resistant elements that do not experience wear while running in and do not damage the internal surface of the casing string because they do not contact it. They are flush mounted in a body having a surface with a larger curvature than the curvature of the reamed borehole made by the rock cutting elements of the reaming unit. Accordingly, the force required for reamer rotating decreased.

Another distinguishing feature of the subject approach is that at least a portion of cylinders forming the reamer body is made about the common axis. Axes of at least a part of the cylinders forming the body are parallel. A portion of cylinders is limited by surfaces parallel to the cylinder axes. This provides a superior design for the reamer body.

Yet another distinguishing feature of the subject approach is that the longitudinal channel axis is displaced relative to all axes of the body cylinders. This design allows the circulation channel to fall within the clearance limits at different ratio relations between the diameters of body cylinders.

A further distinguishing feature of the subject approach is that the thrust unit is placed on a cylinder having a diameter less than that of the reaming unit. This predetermines a decrease of the force of reamer rotation because the thrust unit is placed on a small diameter.

A yet further distinguishing feature of the subject approach is that the supporting shaft axis is positioned in the thread axis plane or in the plane parallel to the thread axis, parallel or at an angle to the plane perpendicular to the thread axis. This allows production of a reamer which does not impose wear to the casing string while running-in and is made against any constructional design—with conical or cylindrical cones or with any position of the supporting shaft.

Lastly, a distinguishing feature of the subject approach is that the axis of the supporting shaft is placed tangentially to the reamer circumference, and the reamer includes cones interconnected to each other with a common axis. This construction allows high penetration rates to be achieved.

The subject polycentric reamer, is shown in FIG. 1 as a general view in the elevational section;

Figure 1:
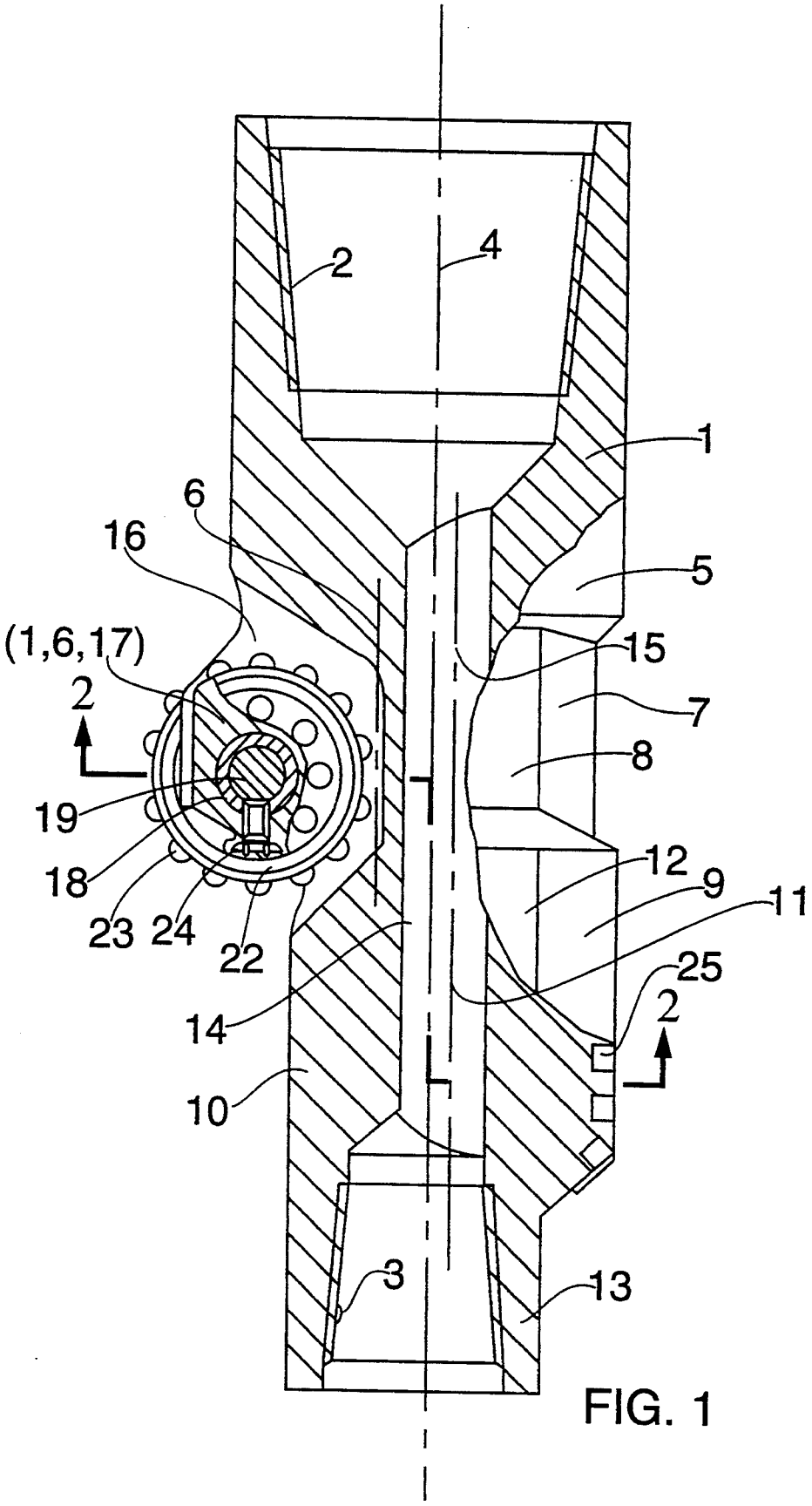
Figure 2:
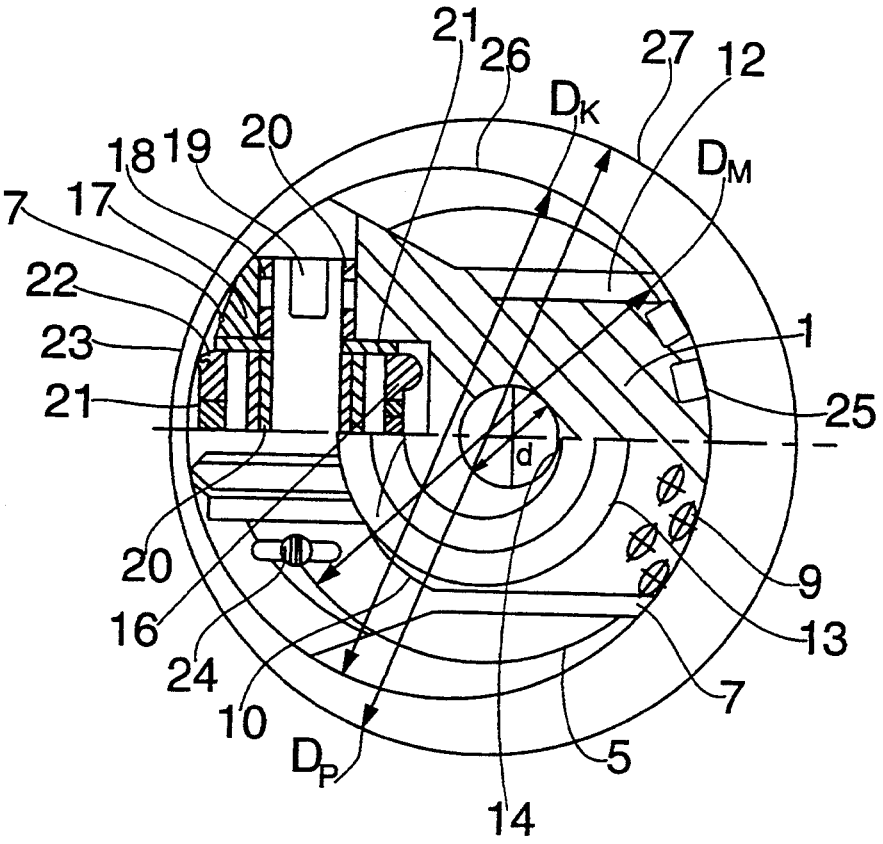
FIG. 2 is the cross-section along the line 2—2 of FIG. 1.

The polycentric reamer body 1 is furnished with upper thread 2 for connection to the drilling tool, and with lower thread 3 for connection of the rock cutting tip tool. Threads 2 and 3 are made relative to their common axis 4. Body 1 is formed by five cylinders made about three axes. Upper cylinder 5 is made about axis 4 (axes of the threads) and is coaxial with threads 2 and 3. Beneath upper cylinders is placed with displacement, cylinder 7 with axis 6, which of all cylinders forming body 1 has the largest diameter (close to the diameter of the casing strings into which the reamer is to be run). Cylinder 7 is limited by surfaces 8 which are parallel to the axes. A body portion placed below is formed by two cylinders, one of which, cylinder 9, is placed on the opposite side of body 1 relative to the outstanding portion of cylinder 7, and has a diameter equal to the diameter of the attached rock cutting tip tool and is made about the axis 4 of threads 2 and 3.

Figure 3:
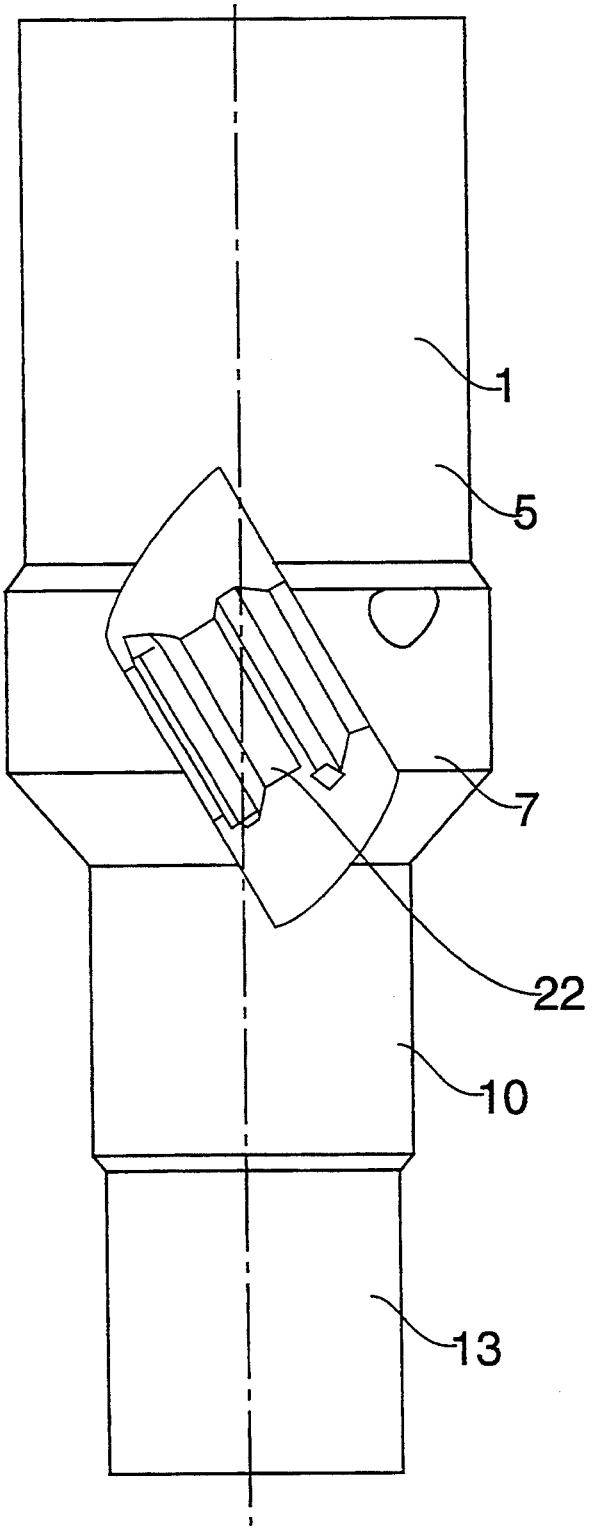
FIG. 3 shows schematically a reamer similar to that shown in FIGS. 1 and 2, but with the slant position of the tangential axis of the supporting shaft of the cones.
Figure 4:
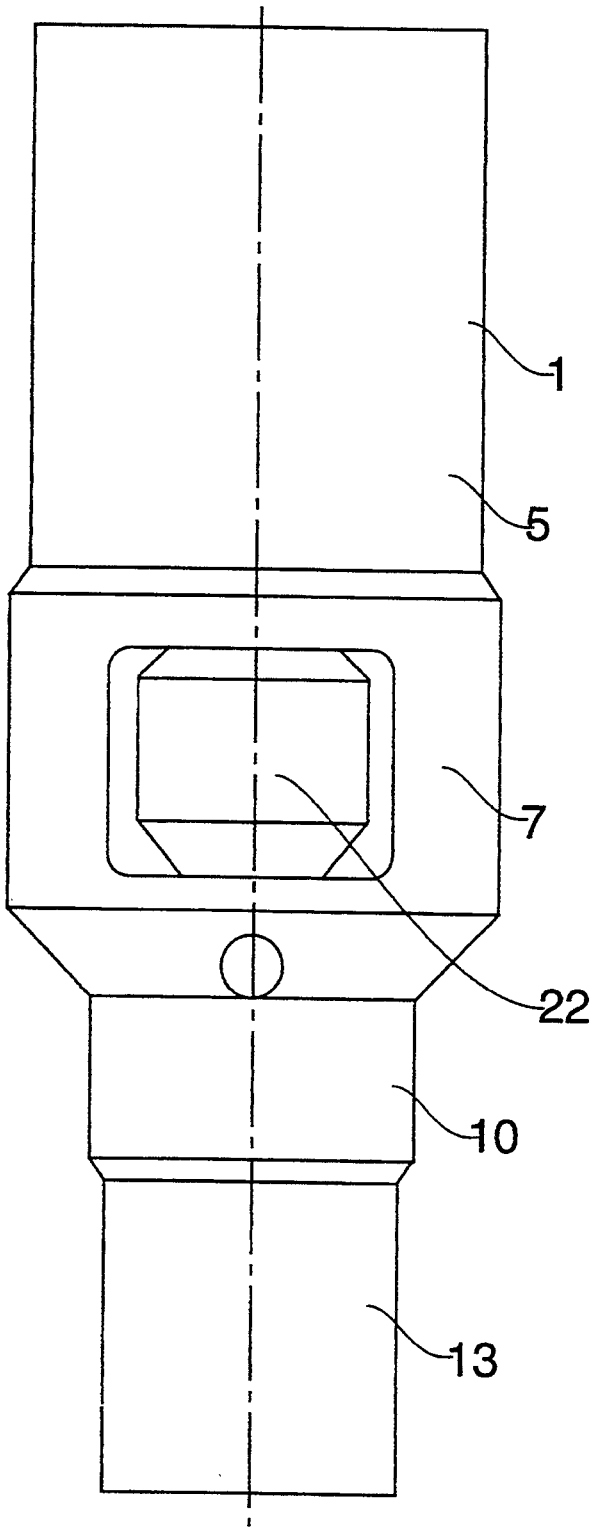
FIG. 4 shows the reamer whose shaft axis is placed in the vertical plane.

The other cylinder 10, placed in the same portion of body 1, in parallel with the cylinder 9, has a diameter less than the diameter of cylinder 9 and is made around axis 11. Cylinders 9 and 10 are interconnected and limited by surfaces 12 (preferably parallel planes), as well as surfaces 8. At least lower cylinder 13, having the smallest diameter, is coaxial with upper cylinder 5. Inside body 1, is a longitudinal channel 14. It is preferable that the axis of the longitudinal channel 14 does not coincide with the axes of cylinders, but rather is parallel to them. The described polycentric reamer may be designed and produced in different overall dimensions. The axes of several cylinders may coincide and the longitudinal channel may be inclined. It is also notable that cylinders 5 and 13 may be non-coaxial with each other and with threads 2 and 3. Preferably, threads 2 and 3 are coaxial. Opening 16 made in cylinder 7 forms, together with surfaces 8, two bars (jaws) 17 of body 1, through which a through port 18 is made. Port 18 is positioned tangentially to the cylinders of body 1, in the plane perpendicular to the longitudinal axis 4 (FIG. 1), or at an angle to this plane (FIGS. 3 and 4). Mounted in opening 16 on the supporting shaft 19 (with the help of bushings 20 and washers 21) is one or preferably several cones 22 having the common axis. Cones 22 are furnished with rock cutting elements 23. Shaft 19 is fixed in body 1 with the help of lock latch 24. The shaft axis can be positioned in the plane of the thread axis, tangential to the reamer circumference. The cylinder is furnished with wear-resistant elements 25. Shaft 19 is fixed in body 1 with the help of lock-latch 24. The shaft axis can be positioned in the plane of the thread axis or in the plane perpendicular to the thread axis and tangential to the reamer circumference. Cylinder 9 is furnished with wear-resistant elements 25.

The greatest diameter $D_p$ of the polycentric reamer (that is the diameter of the borehole formed while reamer rotates relative to the axis 4) is equal to double the distance from axis 4 to the point most remote from this axis on cutting element 23 of cone 22. Circumference 26 of diameter $D_k$, circumscribed around body 1 from the center beyond axis 4, intersects circumference 27 of borehole of D diameter, (formed by the reamer), and a portion of circumference 26 lies beyond circumference 27. This is the result of the plane perpendicular to axis 4 of connection thread 2 of body 1, which passes through the point most remote from axis 4 to the most remote point of circumference 26 circumscribed around the body from the center beyond axis 4 surmounts the distance from the axis 4 to the most remote point of cutting element 23 of cone 22.

Servicing of the subject polycentric reamer maybe accomplished as following: Rock cutting tip tool is connected to lower thread 3 of the assembled reamer. This reamer with the tip tool connected to the drilling tool by thread 2, is run into the well. Such a tip tool has the diameter equal to the diameter of the thrust unit (i.e. the diameter across the vertexes of elements 25 on cylinder 9), or equal to double the distance from axis 4 to the outer surface of elements 25 on cylinder 9 or to $D_H$. The drill pipe is appropriately installed between the reamer and the tip tool which plays the role of a flexible element and mitigates inaccuracies. The assembled tool is run into the well cased with the casing string with the internal diameter equal to at least $D_k$. Having run the reamer to the point below the casing shoe, the tool is rotated. The tool rotates around axis 4, resulting in local reaming by cutting elements 23 of cone 22. The diameter of the reamed zone is equal to double the distance from axis 4 to the vertex of the most remote to rock cutting element 23 of cone 22. As the tool is fed, and the bottom is being drilled. The borehole is formed having a diameter $D_p$ which surpasses inner diameter $D_k$ of the casing string positioned above. The design features of the polycentric reamer ensure maximum penetration rate in the reamed zone of the well.

At present, a running design model of the polycentric reamer has been developed to ream a pilot borehole of from 215.9 mm to 346 mm in diameter under a casing string of 321 mm diameter.

What is claimed is:

1. A polycentric reamer for reaming bore holes, which comprises:

(a) a body with an upper connection thread, said thread having an axis, and a longitudinal channel, said longitudinal channel having an axis, formed by several non-coaxial cylinders mated to each other, each of said cylinders having an axis;

(b) a thrust unit;

(c) a reaming unit positioned asymmetrically within the body, the reaming unit including at least one cone mounted on a supporting shaft, said supporting shaft having an axis, so that in a plane perpendicular to the thread axis and passing through the cone point furthest from the thread axis, (i) the distance from the thread axis to the furthest point of the body's circumference surpasses the distance from the thread axis to the cone point furthest from the thread axis, and (ii) a circle drawn around the body and centered beyond the thread axis intersects a circle drawn around the reamer at the cone point furthest from the thread axis and centered at the thread axis, so that a portion of the body inscribing circle extends beyond the reamer inscribing circle.

2. A polycentric reamer of claim 1, wherein at least a portion of the cylinders forming the reamer body are made around a common axis.

3. A polycentric reamer of claim 1, wherein the axes of at least a portion of the body forming cylinders are parallel.

4. A polycentric reamer of claim 1, wherein a portion of the cylinders are limited by surfaces parallel to the axes of the cylinders.

5. A polycentric reamer of claim 1, wherein the axis of the longitudinal channel is displaced relative to the axes of the body cylinders.

6. A polycentric reamer of claim 2, wherein the axis of the longitudinal channel is displaced relative to the axes of the body cylinders.

7. A polycentric reamer of claim 1, wherein the thrust unit has a diameter less than the diameter of the reaming unit.

8. A polycentric reamer of claim 1, wherein the axis of the supporting shaft is positioned in a plane parallel to the thread axis.

9. A polycentric reamer of claim 1, wherein the axis of the supporting shaft is positioned tangentially to the reamer circumference.

10. A polycentric reamer of claim 8, wherein the axis of the supporting shaft is positioned tangentially to the reamer circumference.

11. A polycentric reamer of claims 1 further comprising cones interconnected to each other and having a common axis.

12. A polycentric reamer of claim 9 further comprising cones interconnected to each other and having a common axis.

13. A polycentric reamer of claim 1, wherein the axis of the supporting shaft is positioned in the plane of the thread axis.

14. A polycentric reamer of claim 1, wherein the axis of the supporting shaft is positioned in a plane parallel to the plane perpendicular to the thread axis.

15. A polycentric reamer of claim 1, wherein the axis of the supporting shaft is positioned in a plane at an angle to the plane perpendicular to the thread axis.

* * * * *